United States Patent [19]

Kardos

[11] Patent Number: 4,926,798

[45] Date of Patent: May 22, 1990

[54] PROCESS FOR PULSE COMBUSTION

[75] Inventor: Peter Kardos, Longmeadow, Mass.

[73] Assignee: Gas Research Institute, Chicago, Ill.

[21] Appl. No.: 383,671

[22] Filed: Jul. 26, 1989

Related U.S. Application Data

[63] Continuation-in-part of Ser. No. 229,130, Aug. 5, 1988, Pat. No. 4,884,963.

[51] Int. Cl.[5] ..... F22B 31/00

[52] U.S. Cl. ..... 122/24; 431/1

[58] Field of Search ..... 431/1; 122/24

[56] References Cited

U.S. PATENT DOCUMENTS 1,170,834 2/1916 Lovekin .
3,554,182 1/1971 Whitacre .
3,665,153 5/1972 Asakawa .
4,241,723 12/1980 Kitchen .
4,257,355 3/1981 Cook .
4,314,444 2/1982 Putnam et al. .
4,465,024 8/1984 Adams .
4,545,329 10/1985 Adams .
4,637,792 1/1987 Davis .
4,651,712 3/1987 Davis .

FOREIGN PATENT DOCUMENTS 826137 5/1981 U.S.S.R. .

*Primary Examiner*—Carroll B. Dority
*Attorney, Agent, or Firm*—Thomas W. Speckman; Douglas H. Pauley

[57] ABSTRACT

A process for pulse combustion in a horizontal pulse combustor having at least one air inlet flapper valve, at least one fuel inlet flapper valve, a combustion chamber, and a plurality of downstream combustion chamber branches in which each is in communication with a plurality of downstream exhaust tubes. The process includes the steps of introducing air through the air inlet flapper valve into a mixing zone. Fuel is introduced through the fuel inlet flapper valve into the mixing zone. A combustible fuel/air mixture is formed within the mixing and ignition chamber and is ignited there to complete combustion within the combustion chamber. Combustion product gases are exhausted through the combustion chamber branches and further exhausted through the exhaust tubes.

15 Claims, 2 Drawing Sheets

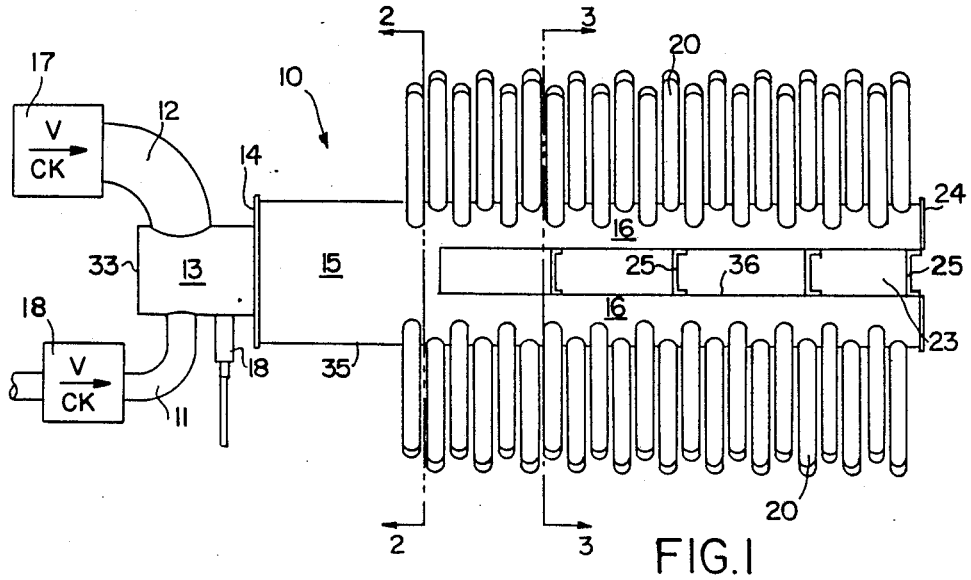
FIG.1
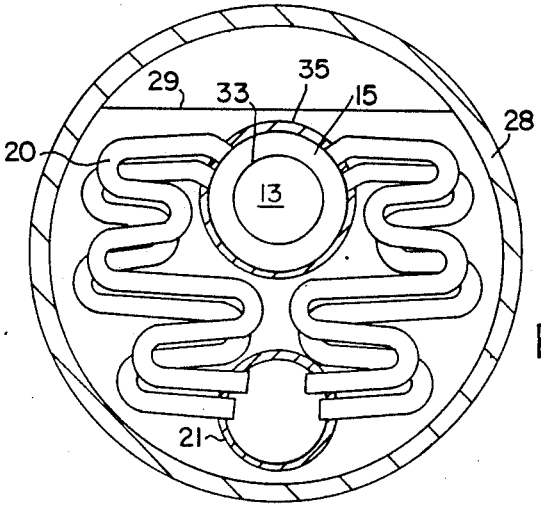
FIG.2
FIG.3
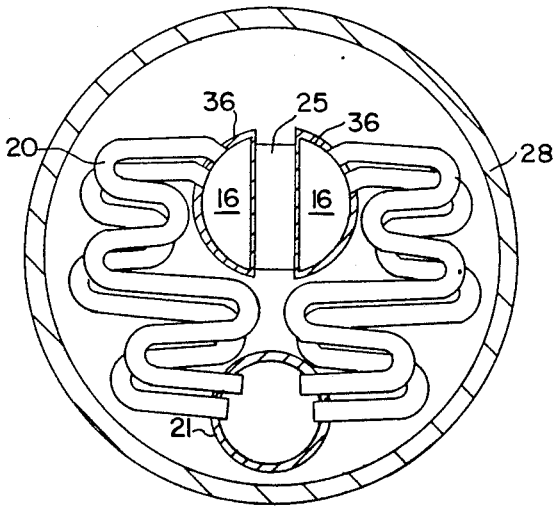

PROCESS FOR PULSE COMBUSTION

CROSS REFERENCE TO RELATED APPLICATIONS

This is a continuation-in-part patent application of my earlier patent application Ser. No. 07/229,130, filed Aug. 5, 1988 and now U.S. Pat. No. 4,884,963.

BACKGROUND OF THE INVENTION

1. Field of the Invention

A process for pulse combustion in a horizontal pulse combustor having a fuel inlet valve, an air inlet valve, a combustion chamber, and a plurality of downstream combustion chamber branches each having a plurality of downstream exhaust tubes.

2. Description of the Prior Art

Pulsing combustion devices and processes are generally known to the art. Putnam et al., U.S. Pat. No. 4,314,444, discloses a two-stage apparatus for burning a fuel and a combustion-sustaining gas. A portion of fuel is burned in a first stage having pulse combustors. The remaining fuel is burned in a second combustion stage with gas that is aspirated using backflow through an aerodynamic valve inlet. The '444 patent discloses a valveless pulse combustor in which the flow of gas in one direction is stronger than the flow of the gas in an opposite direction. The '444 patent teaches a plurality of pulse combustors wherein each pulse combustor has only one combustion chamber and only one outlet conduit. The second combustion stage has one combustion chamber with a multiplicity of exhaust tubes. The '444 patent teaches a vertical arrangement for the heating apparatus.

Kitchen, U.S. Pat. No. 4,241,723, discloses a pulse combustion heater having a combustion chamber and at least one exhaust pipe forming a resonant system with a chamber. The combustion chamber is in the form of a one-piece bronze casting having an internal cavity which is generally of flattened spherical shape.

Whitacre, U.S. Pat. No. 3,554,182, teaches a liquid heater, especially adapted for liquid submerged uses, for example for heating a swimming pool. The combustion generated is of the pulse type and the combustion chamber in which the fuel-air mixture is ignited has a body of material of high radiating potential, such as ceramic, which is heated in the combustion chamber and which radiates heat to the enclosing heat-conducting walls of the chamber in contact with the liquid to be heated.

Severyanin, Russian Pat. No. 826,137, discloses a pulsating combustion unit having an ignition chamber connected to an exhaust chamber through two resonance pipes. One of the resonance pipes has a length which exceeds the length of the other resonance pipe by 3 times to increase combustion efficiency. Combustion products reach the exhaust chamber in an anti-phase thus reducing sound radiation.

Davis, U.S. Pat. No. 4,637,792, describes a pulsing combustion device having a combustion chamber and a floating valve member mounted in reciprocal relation in the wall of the combustion chamber where reciprocation of the floating valve closes and opens communication through ports between the supply of a combustible mixture and the combustion chamber. The '792 patent teaches a single elongated combustion chamber burner shell which defines a combustion chamber. Davis, U.S. Pat. No. 4,651,712, teaches a pulsing combustion device having a combustion chamber with an inlet for a combustible mixture and an unvalved outlet open to the atmosphere for combustion gases. The '712 patent describes an elongated combustion chamber shell or burner shell which defines a combustion chamber. The combustible mixture is ignited and burned in a single combustion chamber.

Adams, U.S. Pat. No. 4,465,024, and Adams, U.S. Pat. No. 4,545,329, teach a water heater having a water tank with a water inlet, a water outlet, and an opening in the side wall of the tank. The combustion chamber assembly has a submergible portion which is adapted to fit within the opening in the tank side wall. The submergible combustion chamber portion comprises a single cylindrical elongated member having an open end and an opposite closed end. A plurality of curved fire tubes are joined to and extend from the closed end of the combustion chamber to a single flue. The Adams patents disclose power combustion systems where fuel and air are force fed to the point where combustion occurs.

Cook, U.S. Pat. No. 4,257,355, teaches a cold water inlet tube located in a horizontal position adjacent the bottom of a commercial water heater. The water heater has a tank formed of a cylindrical shell which is enclosed by a lower head and an upper head. A plurality of vertical flues are disposed inside the tank and extend from the end of the combustion chamber to a single flue. The system operates with a natural draft venting system and not a pulse combustion system.

Asakawa, U.S. Pat. No. 3,665,153, teaches an apparatus and method for heating water to generate steam or provide hot water. A burner is positioned in a combustion chamber having heat exchanger pipes passing from one end of the combustion chamber to a chimney. The combustion system operates with a natural draft venting system, not an acoustically tuned pulse combustion system.

Lovekin, U.S. Pat. No. 1,170,834, teaches a thermostatic valve mechanism which supplies gas to a burner of a heater. FIG. 1 of the '834 patent shows a single corrugated combustion chamber with a flue exiting from one end.

SUMMARY OF THE INVENTION

It is one object of this invention to provide a process for pulse combustion in a horizontal pulse combustor having a fuel inlet valve, an air inlet valve, a mixing chamber in communication with a combustion chamber, and a plurality of downstream combustion chamber branches, each in communication with a plurality of downstream exhaust tubes.

It is another object of this invention to provide a process for pulse combustion in which combustion product gases flow through downwardly sloping exhaust tubes to prevent condensate build-up.

It is another object of this invention to provide a process for pulse combustion in a pulse combustor having an air inlet flapper valve and a fuel inlet flapper valve.

It is another object of this invention to provide a pulse combustor having a combustion chamber which properly aspirates and does not create excessive noise levels.

It is another object of this invention to provide a pulse combustor that is easy to manufacture and requires no special machining, dies, molds or the like.

It is another object of this invention to provide a pulse combustor having a single cavity combustion chamber which splits first into a plurality of combustion chamber branches, further into a plurality of exhaust tubes and thus has greater surface area for increased heat transfer.

It is another object of this invention to provide a pulse combustor which has a single mixing and ignition chamber.

It is yet another object of this invention to provide a pulse combustor having a single combustion chamber which splits into a plurality of combustion chamber branches each having a cross-sectional area less than the cross-sectional area of the single combustion chamber.

In a preferred embodiment of this invention, a process for pulse combustion occurs in a pulse combustor, operating in a horizontal position relative to ground, having an air inlet flapper valve, a fuel inlet flapper valve, a mixing chamber in communication with a combustion chamber, and a plurality of downstream combustion chamber branches in which each is in communication with a plurality of downstream exhaust tubes. The process includes the steps of introducing air through the air inlet flapper valve into a mixing chamber and introducing fuel through the fuel inlet flapper valve, also into the mixing chamber. The fuel and air form a combustible fuel/air mixture within the combustion chamber. The fuel which is introduced into the mixing chamber preferably is gaseous. The fuel/air mixture is ignited to produce combustion within the combustion chamber. Combustion product gases are then exhausted through the combustion chamber branches and further exhausted through the exhaust tubes. The combustion product gases can be further exhausted from the exhaust tubes into an exhaust manifold.

In one embodiment according to this invention, the mixing and ignition chamber is positioned downstream from the air inlet flapper valve and the fuel inlet flapper valve and is positioned upstream from the combustion chamber. Thus, flashback cannot proceed through either the air or fuel line and neither contains a combustible mixture.

In a preferred embodiment according to this invention, the combustion product gases flow through downwardly sloping exhaust tubes. Such configuration permits fluid flow through the exhaust tubes without condensation build-up.

In one embodiment of this invention, the pulse combustor has an exterior surface which is surrounded by a fluid, preferably water. Heat generated from combustion is transferred through the exterior surface of the pulse combustor to the fluid. In one embodiment, the exterior surface of the pulse combustor is at least partially corrugated for increased heat transfer, increased relative to the heat transfer of a similar pulse combustor without corrugated walls. The heat transfer from the exterior surface to the surrounding fluid can also be relatively increased by having at least one fin secured to the exterior surface of the pulse combustor.

Each exhaust tube has a cross-sectional area less than the cross-sectional area of each combustion chamber branch. In one embodiment, a summation of cross-sectional areas of each exhaust tube is less than a summation of cross-sectional areas of each combustion chamber branch. In another embodiment, a summation of cross-sectional areas of each combustion chamber branch is less than the cross-sectional area of the combustion chamber.

In another preferred embodiment of this invention, a pulse combustor apparatus has a combined mixing and ignition chamber in communication with a fuel inlet tube and an air intake tube. The fuel inlet tube and air inlet tube inject fuel and air, respectively, to form a combustible fuel/air mixture in the combined mixing and ignition chamber. The combined mixing and ignition chamber has an ignition source located within the mixing and ignition chamber for igniting the fuel/air mixture.

The pulse combustor also has a combustion chamber in communication with the mixing and ignition chamber. The combustion system has a single combustion chamber which first splits into a plurality of downstream combustion chamber branches, then each downstream combustion chamber branch further splits into at least one, preferably a plurality of exhaust tubes. The combustion chamber branches of the combustion chamber have a slot between the combustion chamber branches. At least one reinforcing strut is secured to the wall of the combustion chamber branches within the slot between the combustion chamber branches.

At least one exhaust tube has a chamber end sealably secured to and in communication with the wall of the combustion chamber. Each exhaust tube has an exhaust manifold end sealably secured to and in communication with an exhaust manifold.

The fuel inlet tube is sealably secured to the wall of the mixing and ignition chamber and is in communication with a mixing and ignition chamber. Likewise, the air inlet tube is sealably secured to the wall of the mixing and ignition chamber and is in communication with the mixing and ignition chamber. Each combustion chamber branch has a cross-sectional area less than the cross-sectional area of the main combustion chamber. Each exhaust tube has a cross-sectional area less than the cross-sectional area of the combustion chamber branch with which the exhaust tube is in communication.

According to one embodiment of this invention, the main combustion chamber and its combustion chamber branches have corrugated sides for increased heat transfer. In another embodiment of this invention, the main combustion chamber and its combustion chamber branches have at least one fin secured to and extending from at least one side of the combustion chamber, including its combustion chamber branches, for increased heat transfer.

BRIEF DESCRIPTION OF THE DRAWINGS

FIG. 1 shows a top view of a pulse combustor having a main combustion chamber with two combustion chamber branches and a plurality of exhaust tubes according to one embodiment of this invention, FIG. 1 does not show the exhaust manifold of the pulse combustor;

FIG. 2 shows a cross-sectional view along line 2—2 of a submerged pulse combustor as shown in FIG. 1;

FIG. 3 shows a cross-sectional view along line 3—3 of a pulse combustor as shown in FIG. 1;

DESCRIPTION OF THE PREFERRED EMBODIMENTS

Figure 4:
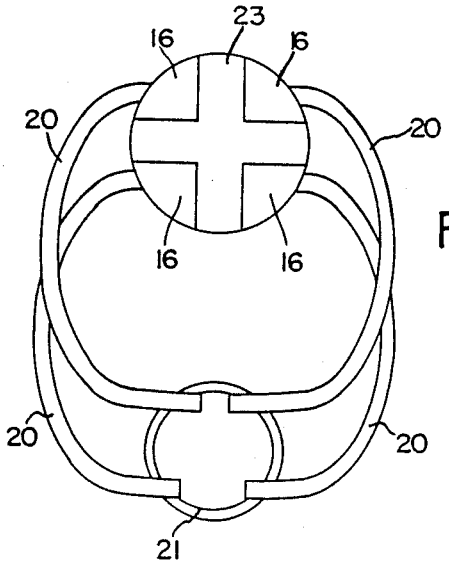
FIG. 4 shows an end view of a pulse combustor having a main combustion chamber with four combustion chamber branches and two slots according to one embodiment of this invention.

Pulse combustion is an acoustically controlled oscillating combustion where sinusoidal pressure waves are generated in a combustion chamber. After initial ignition, combustion will continue without further ignition from an ignition source such as a spark plug or the like. The frequency of oscillation within the combustion chamber is mainly a function of the combustion chamber volume, the total cross-sectional area of the exhaust tubes, the length of the exhaust tubes and the speed of sound.

One major advantage of this invention is the greatly enhanced heat transfer as compared with the heat transfer achieved in a conventional combustor. In a combustor according to this invention, a major portion of heat is transferred through the walls of the combustion chamber, thus a configuration having increased surface area without a proportional increase in the volume of the combustion chamber provides greater heat transfer.

In a preferred embodiment of this invention, a process for pulse combustion occurs within pulse combustor 10 as shown in FIGS. 1, 2 and 3. The process preferably occurs within an embodiment of pulse combustor 10 having fuel inlet valve means, air inlet valve means, combustion chamber 15, and a plurality of downstream combustion chamber branches 16. Each combustion chamber branch 16 is in communication with a plurality of downstream exhaust tubes 20.

The pulse combustion process begins with introducing air through the air inlet valve means into mixing and ignition chamber 13. In a preferred embodiment, the air inlet valve means comprises at least one air inlet flapper valve 17 positioned upstream from and in communication with mixing and ignition chamber 13, as shown in FIG. 1.

Fuel is introduced through the fuel inlet valve means into mixing and ignition chamber 13, as shown in FIG. 1. In a preferred embodiment of this invention, the fuel inlet valve means comprises at least one fuel inlet flapper valve 18 positioned upstream from and in communication with mixing and ignition chamber 13. In one preferred embodiment of this invention, the fuel is a gaseous fuel suitable for combustion within the combustion zone.

It is apparent that the air inlet valve means and/or the fuel inlet valve means may comprise other known valves suitable for pulse combustion. In particular, a suitable flapper check valve for either the air or fuel is described in U.S. patent application having Ser. No. 229,129, filed Aug. 5, 1988, and now U.S. Pat. No. 4,856,558 which is incorporated into this patent application by reference.

The fuel and air introduced into the mixing chamber combine to form a combustible fuel/air mixture within the mixing zone. The fuel/air mixture is then ignited to produce combustion within combustion chamber 15. Combustion product gases are then exhausted through combustion chamber branches 16 and then further exhausted through exhaust tubes 20.

In one preferred embodiment of this invention, the mixing zone includes the volume of mixing and ignition chamber 13 which is located upstream from combustion chamber 15. It is apparent that combustion may occur in mixing and ignition chamber 13 and continue in combustion chamber 15.

The combustion product gases are preferably exhausted through downwardly sloping exhaust tubes 20. Such downward slope of each exhaust tube 20, as shown in FIGS. 2 and 3, prevents build-up of condensate within each exhaust tube 20. In another embodiment of this invention, the process further includes the step of exhausting the combustion product gases into exhaust manifold 21 which is positioned downstream from exhaust tubes 20.

Figure 6:
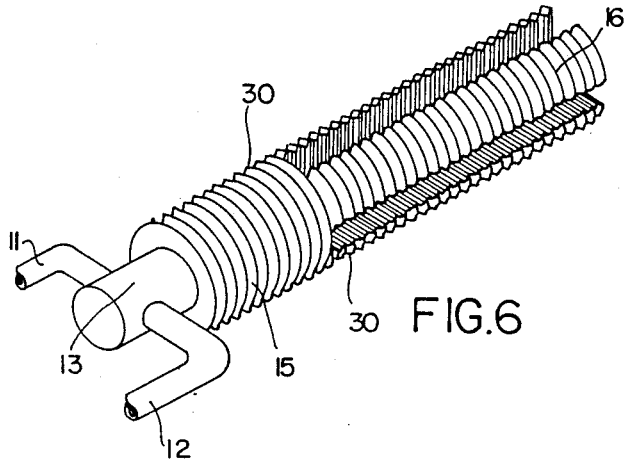
FIG. 6 shows a perspective view of a pulse combustor with the main combustion chamber and four combustion chamber branches having corrugated sides according to one embodiment of this invention.

In a preferred embodiment according to this invention, pulse combustor 10 including exhaust tubes 20 and exhaust manifold 22 are submerged within a fluid, preferably water, as shown in FIG. 2 by liquid level 29. Heat transfer from pulse combustor 10 to the surrounding fluid can be increased by pulse combustor 10 having at least a portion of the exterior surface of combustion chamber 15 and/or combustion chamber branches 16 with corrugations 30, as shown in FIG. 6. The heat transfer can also be increased by having at least one fin secured to the exterior surface of combustion chamber 15 and/or combustion chamber branch 16.

To accommodate proper fluid flow conditions throughout pulse combustor 10, one preferred embodiment of this invention includes each exhaust tube 20 having a cross-sectional area less than the cross-sectional area of each combustion chamber branch 16. In another preferred embodiment, the summation of the cross-sectional areas of each exhaust tube 20 within each combustion chamber branch is less than the of cross-sectional area of each combustion chamber branch 16. In another preferred embodiment, the summation of cross-sectional areas of each combustion chamber branch 16 is less than the cross-sectional area of combustion chamber 15.

In a preferred embodiment of the apparatus of this invention as shown in FIGS. 1, 2 and 3, pulse combustor 10 has fuel inlet tube 11 and air inlet tube 12 sealably secured to mixing and ignition chamber wall 33 and in communication with mixing and ignition chamber 13 as defined by mixing and ignition chamber wall 33. It is apparent that fuel inlet tube 11 and air inlet tube 12 can be sealably secured to mixing and ignition chamber wall 33 by a welded connection, a screwed connection, by having fuel inlet tube 11 and air inlet tube 12 as channels within a block in lieu of tubes, or the like. Fuel inlet tube 11 injects fuel and air inlet tube 12 injects combustion air into mixing and ignition chamber 13 forming a combustible fuel/air mixture within mixing and ignition chamber 13.

An ignition source is located within mixing and ignition chamber 13 for igniting the fuel/air mixture within mixing and ignition chamber 13. It is apparent that ignitor 18 can be a spark plug, glow plug or other ignition source known to the art. Once combustion occurs from an initial ignition source, pulse combustor 10 will operate and combustion will continue without further ignition from the initial ignition source, such as the spark plug, glow plug or the like.

Main combustion chamber 15 as defined by main combustion chamber wall 35 is in communication with mixing and ignition chamber 13. In a preferred embodiment of this invention, main combustion chamber 15 has transition plate 14 sealably secured to one end of main combustion chamber wall 35. Transition plate 14 has a through hole in communication with mixing and ignition chamber 13. It is apparent that mixing and ignition chamber wall 33 can secure to either transition plate 14 or combustion chamber wall 35 by a welded connection, a screwed connection, by having mixing and ignition chamber wall 33 and main combustion chamber wall 35 one molded piece, or the like.

As shown in FIG. 1, main combustion chamber 15 splits into a plurality of downstream combustion chamber branches 16 as defined by combustion chamber branch walls 36. A plurality of exhaust tubes 20 are attached to main combustion chamber wall 35 and/or combustion chamber branch wall 36 along a longitudinal axis of main combustion chamber 15. FIGS. 1 and 3 show main combustion chamber 15 having two combustion chamber branches 16 and several exhaust tubes 20. FIGS. 4, 5, 6 and 7 show main combustion chamber 15 having four combustion chamber branches 16. It is apparent that main combustion chamber 15 can split into two or more downstream combustion chamber branches 16. Such branching arrangement provides increased heat transfer by providing more surface area and increased contact of the combustion gases with the inside surfaces of the heat exchanger.

Combustion chamber branches 16 have "U" shaped slot 23 located between combustion chamber branches 16 of main combustion chamber 15. In a preferred embodiment of this invention, at least one reinforcing strut 25 spans slot 23 and is secured between combustion chamber branch walls 36. Reinforcing strut 25 provides rigid support for combustion chamber branch walls 36.

In a preferred embodiment of this invention, combustion chamber branches 16 of main combustion chamber 15 have end plates 24 sealably secured to combustion chamber branch walls 36. It is apparent that combustion chamber branches 16 can be sealed by having combustion chamber walls 36 welded together, by having one molded piece, by being connected to another chamber or tube, or the like.

Depending upon the specific design of pulse combustor 10, combustion can be completed either in main combustion chamber 15 or combustion can continue in main combustion chamber 15 and carry into combustion chamber branches 16 for completion of combustion. Whether complete combustion occurs in main combustion chamber 15 or carries into combustion chamber branches 16 depends upon the total volume and configuration of main combustion chamber 15 and combustion chamber branches 16. The location of complete combustion also depends upon the flame speed, reaction time, and the number, spacing and size of exhaust tubes 20. In a preferred embodiment of this invention, complete combustion occurs within main combustion chamber 15 and does not carry into combustion chamber branches 16.

As shown in FIGS. 1, 2 and 3, each exhaust tube 20 has a chamber end sealably secured to and in communication with main combustion chamber wall 35 and/or combustion chamber branch wall 36. Each exhaust tube 20 also has an exhaust manifold end sealably secured to and in communication with exhaust manifold 21 as shown in FIG. 2. In one embodiment of this invention, a plurality of exhaust tubes 20 are sealably secured to main combustion chamber wall 35 and combustion chamber branch walls 36 along a longitudinal axis of main combustion chamber 15 and along the longitudinal axis of combustion chamber branches 16. Such longitudinal arrangement provides increased heat transfer by providing more surface area for heat exchange. It is apparent that exhaust tubes 20 can be sealably secured to main combustion chamber wall 35 and/or combustion chamber branch walls 36 and exhaust manifold 21 by using welded connections, screwed connections, channel means or the like.

In a preferred embodiment of this invention, exhaust tubes 20 have a downwardly sloped and staggered configuration as shown in FIGS. 2 and 3. It is apparent that exhaust tubes 20 can have other tortuous shaped configurations. However, staggered exhaust tubes 20 provide a convenient configuration for attaching a plurality of exhaust tubes 20 to main combustion chamber wall 35 and/or combustion chamber branch walls 36. Downwardly sloped exhaust tubes 20 prevent water or condensation from the flue gas from collecting in exhaust tubes 20. With the downwardly sloped configuration, any condensate can drain into exhaust manifold 21 from which such condensation can be easily removed. Condensation will collect either during initial start-up of a relatively cold pulse combustor 10 or when pulse combustor 10 acts as a condensing unit and achieves very high thermal efficiencies.

Each combustion chamber branch 16 has a cross-sectional area less than the cross-sectional area of main combustion chamber 15. Each exhaust tube 20 has a cross-sectional area less then the cross-sectional area of the combustion chamber branch 16 to which the exhaust tube 20 is in communication. Exhaust tubes 20 can be secured to main combustion chamber wall 35 and/or combustion chamber branch walls 36 at a location where combustion is nearly complete, preferably exhaust tubes 20 are secured to combustion chamber branch walls 36 so that the combustion gases flow through combustion chamber branches 16 providing heat transfer to combustion chamber branch walls 36 rather than flowing primarily through the path of least resistance which would be those exhaust tubes 20 secured to main combustion chamber wall 35. In one embodiment of this invention, main combustion chamber wall 35 and combustion chamber branch wall 36 are corrugated and thus provide greater surface area for increased heat transfer. FIGS. 6 and 7 show main combustion chamber wall 35 and combustion chamber branch walls 36 having corrugations. It is apparent that main combustion chamber wall 35 and/or combustion chamber branch wall 36 can have fins or other heat transfer means secured to the walls for increased heat transfer.

Figure 5:
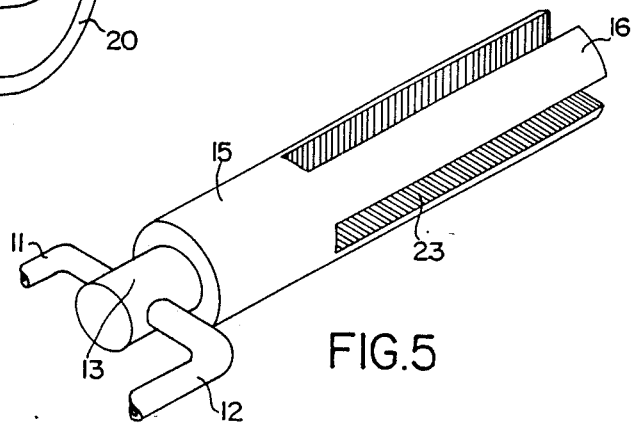
FIG. 5 shows a perspective view of a pulse combustor having a main combustion chamber with four combustion chamber branches and two slots according to one embodiment of this invention.

FIGS. 4, 5 and 6 show main combustion chamber 15 having four combustion chamber branches 16. As shown in FIG. 4, a plurality of exhaust tubes 20 have a downwardly sloped and curved configuration extending between main combustion chamber 15 and exhaust manifold 21. It is apparent that pulse combustor 10, including exhaust tubes 20, can fit within shell 28, or the like, as shown in FIGS. 2 and 3. FIG. 2 shows pulse combustor 10 operating as a steam boiler where pulse combustor 10, exhaust tubes 20 and exhaust manifold 22 are submerged within shell 28. Liquid level 29 indicates the water level or other liquid level within shell 28.

Several design considerations exist for a pulse combustor according to this invention. Main combustion chamber 15 must have the proper size for a prescribed fuel/air mixture input range. An oversized main combustion chamber 15 may lack proper aspiration capabilities. An undersized main combustion chamber 15 may generate excessive noise levels which are difficult and costly to attenuate. Main combustion chamber 15 must have enough surface area to provide proper heat transfer and main combustion chamber wall 35 and/or combustion chamber branch walls 36 must have enough surface area for easy and proper attachment of exhaust tubes 20. As the cross-sectional area of combustion chamber branches 16 decreases, velocity of the hot combustion products increases thus improving heat transfer. Reinforcement struts 25 provide rigid support for combustion chamber branch walls 36 and also reduce the vibration of the sheet metal surfaces of combustion chamber branch walls 36.

For a combustor having a given total volume of the combustion chamber and any associated combustion chamber branches, pulse combustor 10 according to this invention will have greater overall heat transfer and thus greater heat transfer per unit of surface area than a conventional single combustion chamber pulse combustor having the same total volume.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A process for pulse combustion in a horizontal pulse combustor having fuel inlet valve means, air inlet valve means, a combustion chamber, and a plurality of downstream combustion chamber branches in which each is in communication with a plurality of downstream exhaust tubes, the process comprising the steps of:

introducing air through the air inlet valve means and into a mixing and ignition chamber;

introducing fuel through the fuel inlet valve means and into the mixing and ignition chamber;

forming a combustible fuel/air mixture within the mixing and ignition chamber;

igniting the fuel/air mixture to begin combustion within the mixing and ignition chamber;

exhausting combustion product gases through the combustion chamber branches and further through the exhaust tubes.

2. A process according to claim 1 wherein the combustion of the fuel/air mixture continues into the combustion chamber.

3. A process according to claim 1 wherein the mixing and ignition chamber is upstream of and in communication with the combustion chamber.

4. A process according to claim 1 wherein the exhaust tubes through which the combustion product gases flow are downwardly sloping.

5. A process according to claim 1 further comprising the step of exhausting the combustion product gases downstream from the exhaust tubes into an exhaust manifold.

6. A process according to claim 1 wherein the air inlet valve means through which the air passes further comprise at least one air inlet flapper valve positioned upstream from and in communication with the mixing and ignition chamber.

7. A process according to claim 1 wherein the fuel inlet valve means through which the fuel passes further comprises at least one fuel inlet flapper valve positioned upstream from and in communication with the mixing and ignition chamber.

8. A process according to claim 1 wherein the fuel further comprises a gaseous fuel.

9. A process according to claim 1 further comprising transferring heat generated from combustion to a fluid surrounding an exterior surface of the pulse combustor.

10. A process according to claim 9 wherein the fluid further comprises water.

11. A process according to claim 9 wherein the exterior surface of the pulse combustor is at least partially corrugated for increased heat transfer.

12. A process according to claim 9 further comprising the step of increasing heat transfer to the fluid by having at least one fin secured to the exterior surface of the pulse combustor.

13. A process according to claim 1 wherein each of the exhaust tubes has a tube cross-sectional area less than a branch cross-sectional area of each of the combustion chamber branches.

14. A process according to claim 1 wherein a tube summation of tube cross-sectional areas of each exhaust tube within a corresponding combustion chamber branch is less than a cross-sectional area of the corresponding combustion chamber branch.

15. A process according to claim 1 wherein a branch summation of each branch cross-sectional area of each combustion chamber branch is less than a chamber cross-sectional area of the combustion chamber.

* * * * *